US006948304B2

(12) United States Patent
Blackmore et al.

(10) Patent No.: US 6,948,304 B2
(45) Date of Patent: Sep. 27, 2005

(54) COMPACT UNIVERSAL CONCENTRIC STRANDER WITH TAKE-OFF SHEAVES MOUNTED ON STRANDER SHAFT

(75) Inventors: Andrew Blackmore, King City (CA); Michael Marshall, Richmond Hill (CA)

(73) Assignee: Roteq Machinery Inc., Concord (CA)

( * ) Notice: Subject to any disclaimer, the term of this patent is extended or adjusted under 35 U.S.C. 154(b) by 57 days.

(21) Appl. No.: 10/435,895

(22) Filed: May 11, 2003

(65) Prior Publication Data

US 2004/0221566 A1 Nov. 11, 2004

(51) Int. Cl.[7] ..... D01H 7/24
(52) U.S. Cl. ..... 57/59; 57/314
(58) Field of Search ..... 57/58.3–58.38, 57/59–65, 314

(56) References Cited

U.S. PATENT DOCUMENTS 3,955,348 A * 5/1976 Orlandi ..... 57/13
4,015,415 A * 4/1977 Otsuki et al. ..... 57/314
4,300,339 A * 11/1981 Orlandi et al. ..... 57/58.34
4,317,328 A * 3/1982 Allard ..... 57/59
4,437,297 A * 3/1984 Vespasiani ..... 57/9
4,549,391 A * 10/1985 Toda et al. ..... 57/13
4,574,574 A * 3/1986 Knaak ..... 57/59
5,144,792 A * 9/1992 Lange et al. ..... 57/59
5,282,353 A * 2/1994 Kellstrom, Jr. ..... 57/13

* cited by examiner

*Primary Examiner*—John J. Calvert
*Assistant Examiner*—Shaun R Hurley
(74) *Attorney, Agent, or Firm*—Myron Greenspan, Esq.; Lackenbach Siegel LLP

(57) ABSTRACT

A concentric strander has an elongate concentric shaft that defines a shaft axis and supports for rotatably supporting the concentric shaft. A number of wire bobbins are spaced at substantially equal intervals along the shaft to form spaces between the bobbins. Each bobbin has an axis substantially coextensive with the shaft axis for rotation about the shaft, and each bobbin has a maximum radial diameter. The strander has take-off sheaves, mounted on the shaft, that are associated with a wire bobbin and that take the wires from the bobbins and guide them to a point radially outwardly beyond the maximum predetermined radial bobbin diameter. The take-off sheaves subsequently guide the wires in a direction substantially parallel to the shaft axis and define, on rotation of the concentric shaft, a cylindrical envelope. At a downstream end of the shaft, the strander has a closing device that receives the wires from the bobbins and applies them on a core. A drive rotates the shaft, and the wire take-off sheaves are rotated by the interaction between the sheaves and the paid-off advancing wires. The interbobbin spaces needed to support the wire take-off sheaves have axial dimension substantially independent of the diameters of the wires to be processed by the strander.

20 Claims, 7 Drawing Sheets

COMPACT UNIVERSAL CONCENTRIC STRANDER WITH TAKE-OFF SHEAVES MOUNTED ON STRANDER SHAFT

BACKGROUND OF THE INVENTION

1. Field of the Invention

This invention generally relates to wire and cable manufacturing machinery and, more specifically, to a concentric strander with take-off sheaves mounted on the strander and a method for assembling same.

2. Description of the Prior Art

Cables made of copper or aluminum conductor strands have been produced on a variety of machines, including rigid stranders, tubular stranders, double twist bunchers and planetary cage stranders. One strander design that has a number of advantages over the aforementioned machines is the concentric strander. Its advantages include high product quality resulting from constant wire pull, high quality wind, elimination of bobbins in favor of permanently installed product packages, high productivity, reliability and cost efficiency.

Bobbins are supported on one proposed concentric strander on the strander shaft or rotor and arranged co-axially with a machine or strander axis so that they can rotate about the axis. An arrangement of flyers or take-off devices are provided for each bobbin (single version) or for each pair of adjacent bobbins (twin version). The wire to be stranded is directed from the bobbins over the flyer and then guided radially inwardly into the rotor and subsequently axially to the closing head. However, the known concentric strander has a disadvantage in that the cage length may need to be increased to accommodate heavier gauge wires. This is because the guide system includes sheaves with diameters that need normally to be increased for heavier gauge wires, thus impacting on the spacing or separation between the axially spaced bobbins to accommodate such guide sheaves.

Another form of a concentric strander has been proposed that is composed of two rotating cylinders or rotors mounted in parallel on a rotatable frame. Each rotor carries a number of spools from which wires are paid out. While one rotor is operating in a production line, the other rotor can be loaded. As soon as the cable going through the active rotor is completed, the frame with both rotors is rotated 180°, thus moving the passive rotor, with the spools loaded to the exact required wire lengths, into the production line. The empty spools in the initially active rotor are moved to the loading position, and can now be re-filled. The objective of this design is to reduce the "down time" and to increase production. In this machine, each rotor includes a plurality of spools arranged sequentially on one shaft. These spools are mounted on the rotor. When positioned in the production line, the spools rotate about the strander shaft and the wires are pulled off through corresponding openings. As indicated, each cylinder includes a plurality of bobbins mounted on the hollow shaft, the rotor itself functioning as a joint flyer on which sheaves are mounted for each of the bobbins. When producing the cable, the hollow shaft and the rotor are driven by a motor, each bobbin providing a wire or strand through individual outlets in the rotor and guided to the stranding head. However, such a machine with the two rotating cylinders or rotors mounted on a rotatable frame has a number of disadvantages, including cost, as it is expensive to produce the rotor with the take-off sheaves. Also, the rewinding of the bobbins is unnecessarily complicated by the need to spin the frame by 180° in order to align the filled bobbins with the machine line while moving the empty bobbins to the re-filing or re-winding station. Furthermore, the core wire needs to be cut to facilitate the process.

The aforementioned machine thus utilizes an outside guide system in the form of a tube to support the first guide pulley. The initially described concentric strander in contrast uses an inside guide system with a spider support for the pulleys.

SUMMARY OF THE INVENTION

Accordingly, it is an object of the invention to provide a concentric strander that does not have the disadvantages associates with comparable prior art stranders.

It is another object of the invention to provide a concentric strander that is simple in construction and economical to manufacture.

It is still another object of the invention to provide a concentric strander that minimizes the pitch between packages and subsequently the cage length, while maintaining substantial increases in production speed.

It is yet another object of the invention to provide a concentric strander as in the previous objects in which the pitch of the package and subsequently the cage length is not affected by different wire-guiding geometries associated with different products.

It is a further object of the invention to provide a concentric strander design that can be retro-fitted into existing lines without substantially changing other components in the line.

It is still a further object of the present invention to provide a concentric strander as suggested in the previous objects that can be used not only for conductors but also for spiral processes that require rewinding of material packages, including taping, reinforcing and protecting composite pipes and cables, stranding, binding, identification, screening and armoring of a wide variety of products, round, flat or profiled, etc.

It is yet a further object of the present invention to provide a concentric strander in which the rewind process can include other functions, including the trapezoidal rolling of round input wires with a coating of materials for identification or lubrication, or other comparable functional purposes.

In order to achieve the above objects, as well as others that will become apparent hereinafter, a concentric strander in accordance with the present invention comprises an elongate concentric shaft defining a shaft axis. Bearing support means are provided for rotatably supporting said concentric shaft in a plurality of wire bobbins substantially equally spaced from each other along said shaft to form interbobbin spaces. Each bobbin has a bobbin axis substantially coextensive with said shaft for rotation about said shaft. The bobbins each have maximal radial diameters. Take-off means are mounted on said shaft and associated with a wire bobbin for taking off a wire wound on a bobbin and guiding it from said bobbin to a point radially outward of said maximum predetermined radial diameter and subsequently guiding the wire along a direction substantially parallel to said shaft axis to define, upon rotation of said concentric shaft, a cylindrical envelope. Closing means are provided at a downstream end of said shaft for receiving the wires from each of said bobbins and applying them on a core. First drive means is provided for rotating said shaft and second drive means is provided to driving said wire take-off means. Said interbobbin spaces required to support said wire take-off means have axial dimensions substantially independent of the diameters of the wires that need to be processed by the strander.

The invention also contemplates the method of assembling a concentric strander of the type suggested by mounting the wire take-off or flyer elements, such as sheaves, at a point radially outwardly beyond the maximum predetermined radial diameter defined by the bobbins. This method can be used to initially manufacture concentric stranders in accordance with the present invention, or to retro-fit existing concentric stranders.

Thus, the present invention differs from the prior art concentric stranders in that it uses a support with an outside guide system while achieving the same advantages and objectives of the prior art stranders.

BRIEF DESCRIPTION OF THE DRAWINGS

The above and other objects of the invention may be more readily seen when viewed in conjunction with the accompanying drawings, wherein.

DESCRIPTION OF THE PREFERRED EMBODIMENTS

Figure 1:
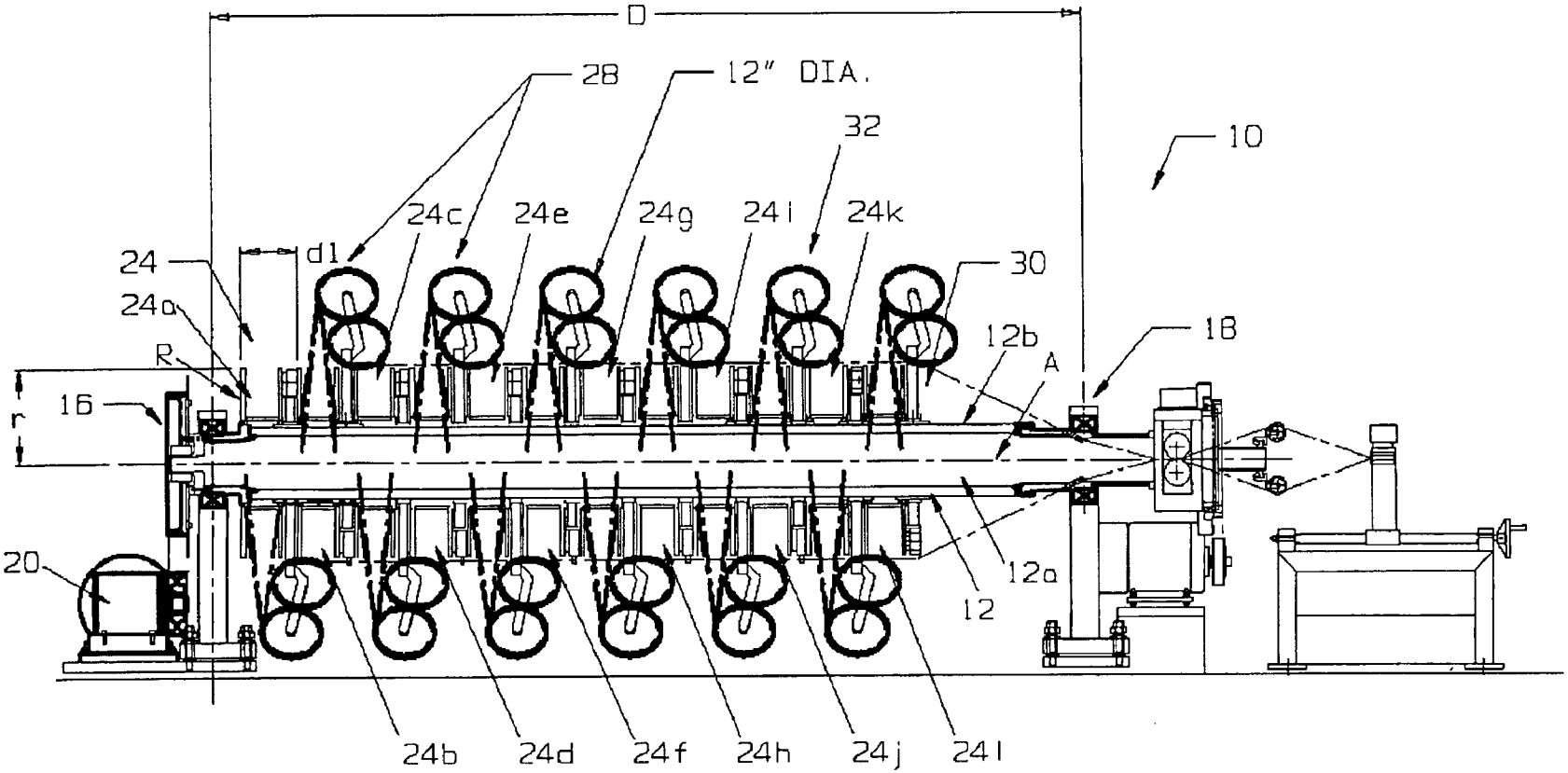
FIG. 1 is a side elevational view, in schematic, of a concentric strander in accordance with the present invention, in which the take-off sheaves are directly mounted on the strander shaft.

Referring now specifically to the Figures, in which identical or similar parts are designated by the same reference numerals throughout, and first referring to FIG. 1, a compact universal concentric strander in accordance with the present invention is generally designated by the reference numeral 10.

The concentric strander 10 includes a strander shaft 12 that has a concentric bore 12*a* and an exterior surface 12*b*. The strander shaft 12 defines a generally horizontal axis A and is rotatably mounted at its upstream and downstream ends 16, 18, respectively, on bearing supports, in a conventional manner. A drive motor 20 is provided to rotate the strander shaft 12 about the axis A.

As with the prior art central stranders, the strander 10 is provided with a plurality of bobbins 24 that are rotatably mounted on the strander shaft 12 and substantially uniformly spaced from each other along the shaft, as shown. In the embodiment illustrated, the concentric strander 10 includes twelve bobbins 24*a*–24*l*, substantially uniform interbobbin bobbin spaces being defined being each two next adjacent bobbins on the strander shaft. Each bobbin, therefore, effectively occupies an axial length or distance $d_1$ along the shaft, representing the axial width of the bobbin, together with the associated interbobbin spaces. In order to minimize the axial length of the strander, it is clear that the distance $d_1$ needs to be kept as small as possible, as this distance is multiplied by the total number of bobbins on the unit. This is done to minimize, as suggested, the overall axial length of the strander, generally represented by the dimension D in FIG. 1. The processing of the wires beyond the strander itself is conventional, and the strander 10 may be used in a line similar to the manner in which conventional stranders are currently being used. An important feature of the invention is the manner in which take-off devices 28 are arranged and positioned, and the manner in which these remove and guide the wire W from the individual bobbins to the downstream end of the strander.

Figure 2:
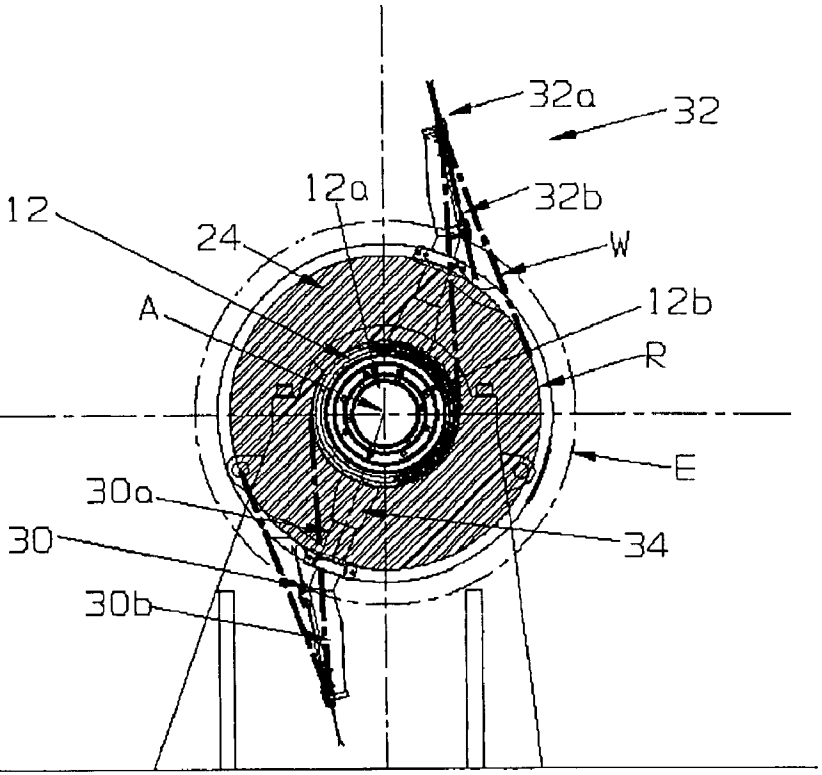
FIG. 2 is a front elevational view, in cross-section, to illustrate one of the take-off mechanisms mounted on the concentric shaft in accordance with the invention.
Figure 3:
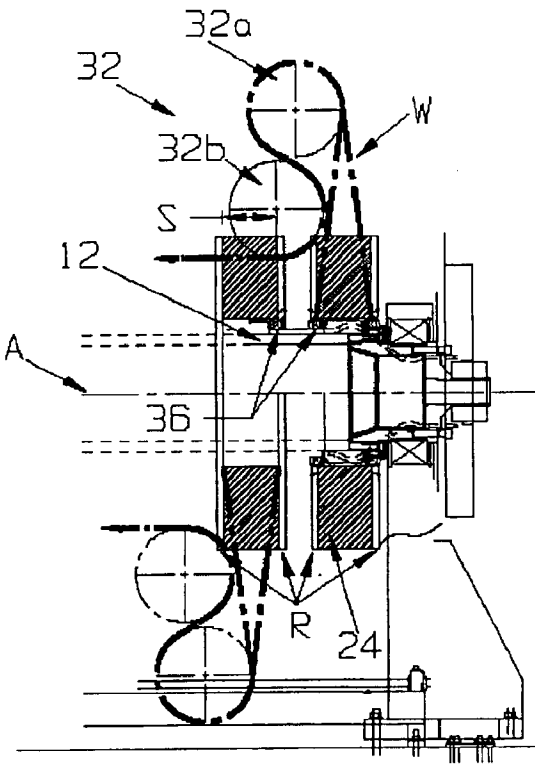
FIG. 3 is a side elevational view of the embodiment shown in FIG. 2.

As will be evident from FIGS. 1 and 3, each of the bobbins 24*a*–24*l* has axially spaced rims R each having a predetermined radius r. The outermost peripheral edges of the rims, therefore, define the minimum radial dimension r for the longitudinal movement of the paid-off wires along a direction parallel to the axis A. The take-off devices in the form of pulleys or sheaves 28 are mounted on the strander shafter 12 by means of suitable supports 30. The pay-off sheaves 28 are positioned to guide the wires from each of the bobbins in a direction parallel to the axial direction and are radially spaced from the axis A to clear the rims R of the bobbins 24, and the wires W define a cylindrical envelope E (FIG. 2) when the wires are rotated about the axis A. It should be clear from FIGS. 1 and 2 that the bobbins and their associated rims are contained within the envelope E while the pay-off sheaves 28 are positioned just beyond the envelope.

The supports 30 extend from points just beyond the envelope E radially inwardly to the exterior surface 12*b* of the strander shaft, and are rigidly fastened thereto. The specific configuration or shape of the supports 30 is not critical for purposes of the present invention. It is only important that the supports have a smaller axial dimension than the interbobbin spaces S so that they can radially extend through the spaces and be fastened to the strander shaft. It will be cleaer, from the construction shown in FIG. 1, that the sheaves 28 forming the take-off or pay-off devices can be provided with different diameters without affecting the interbobbin spaces as only the supports 30 need to extend through such spaces and not the sheaves themselves. By projecting the supports 30 beyond the envelope E, therefore, the sheaves of the pay-off or take-out devices can be made smaller, to accommodate lighter-gauge wires or conductors. The diameters of the sheaves do not, therefore, affect the interbobbin spaces so that the overall axial length D of the concentric strander 10 can be kept constant and at a minimum axial length irrespective of the gauges of the wires or conductors being processed.

Referring to FIGS. 2 and 3, one embodiment is shown for a configuration or arrangement of sheaves of the pay-off or take-off device. It consists of the support 30 mounted on the concentric shaft 12 proximate to an associated wire bobbin and extends radially beyond the maximum predetermined radial diameter defined by the outermost edges of the rim R. At least one sheave is rotatably mounted on each support 30 to position the sheave totally beyond the cylindrical envelope E. In the embodiment of FIGS. 2 and 3, two sheaves 32*a*, 32*b* are used. The initial sheave 32*a* accepts the wire W from the bobbin and advances the wire, irrespective of the fleeting angle, to the second sheave 32*b*, which re-directs the wire along the axial direction that also defines the envelope E. In this embodiment, the first sheave 32*a* has an axis of rotation A1 inclined relative to a horizontal plane extending through the shaft axis A. Thus, the first sheave 32*a* for initially engaging a wire has an axis of rotation A1 inclined relative to the horizontal plane extending through the shaft axis A. In this embodiment, also, the first sheave 32*a* is substantially co-planar with the second sheave 32*b* for redirecting the wire along the cylindrical envelope E.

Forming part of the support 30, or as a separate member, a further portion 30*c* is generally aligned with the support portion 30*a* and is arranged diametrically opposite thereto for supporting a counterweight 34. A support extension 30*b*, extending from the support portion 30*a*, orients the sheaves as described. The portions 30*a* and 30*b* are offset by an angle α. This angle is not critical, and is chosen to suit the material and the process. Typically, the enclosed angle is between 165° and 170°.

Figure 4:
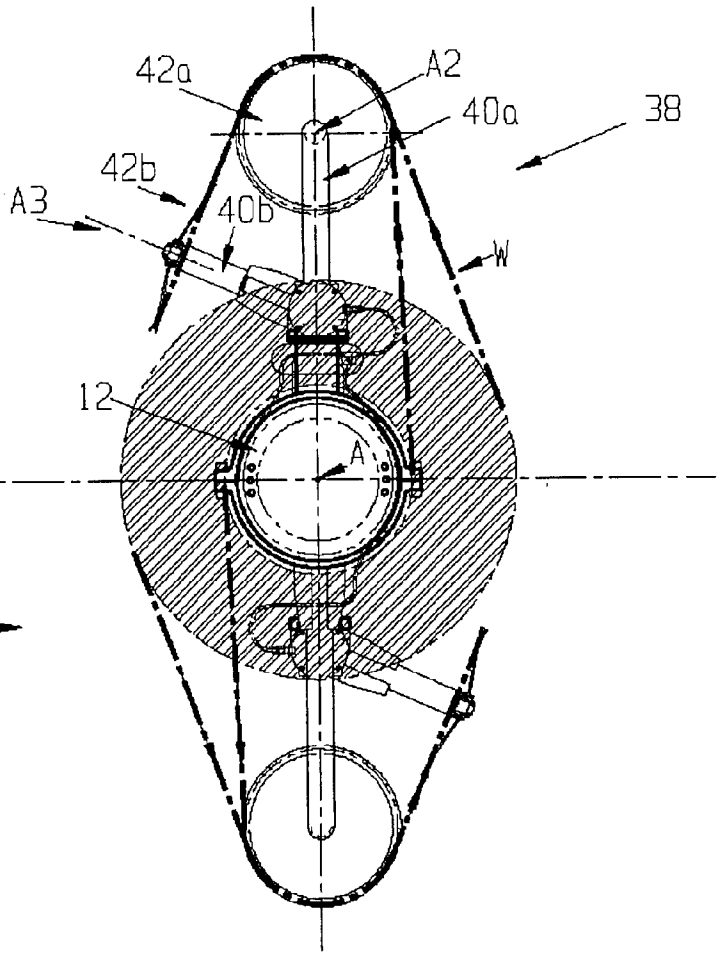
FIG. 4 is similar to FIG. 2, but illustrates an alternate arrangement of the pulleys forming part of the take-off mechanism.
Figure 5:
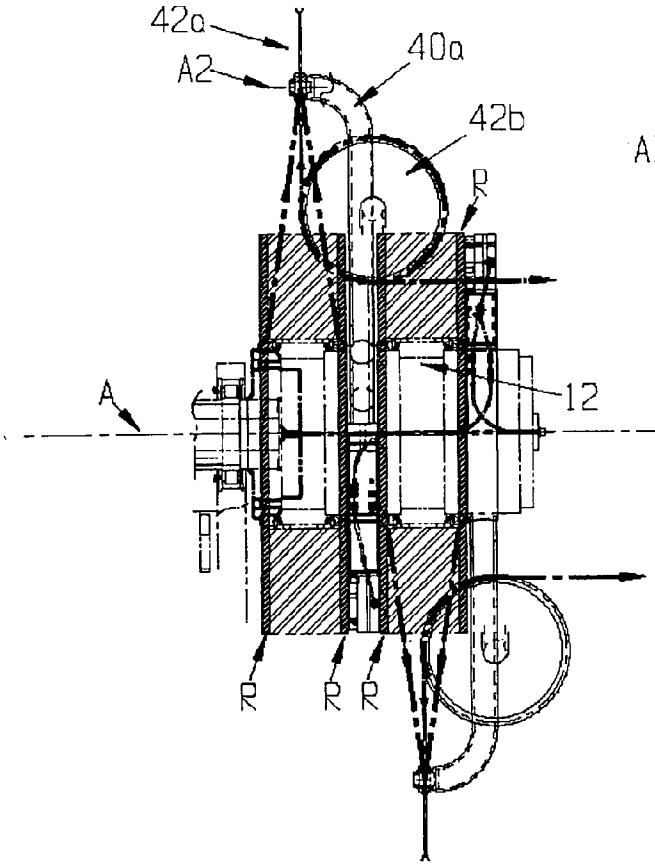
FIG. 5 is a side elevational view of the embodiment illustrated in FIG. 4.

Referring to FIGS. 4 and 5, an alternate arrangement of take-off sheaves is shown, in which the first or initial sheave 42*a*, for initially engaging a wire W, has an axis of rotation A2 substantially parallel to the shaft axis A, in which the axis A2 is offset from the axis A3 of the second sheave 42*b*, which redirects the wire along the cylindrical envelope E. The axes A2 and A3 are, in this embodiment, offset from each other by an angle of 90°. Such offset is made possible by using a radial support portion 40*a* and an offset portion 40*b* that extends along the axial direction A3 of the second sheave 42*b*. As indicated, the second sheave is inclined relative to a horizontal plane extending through the shaft axis A.

Figure 6:
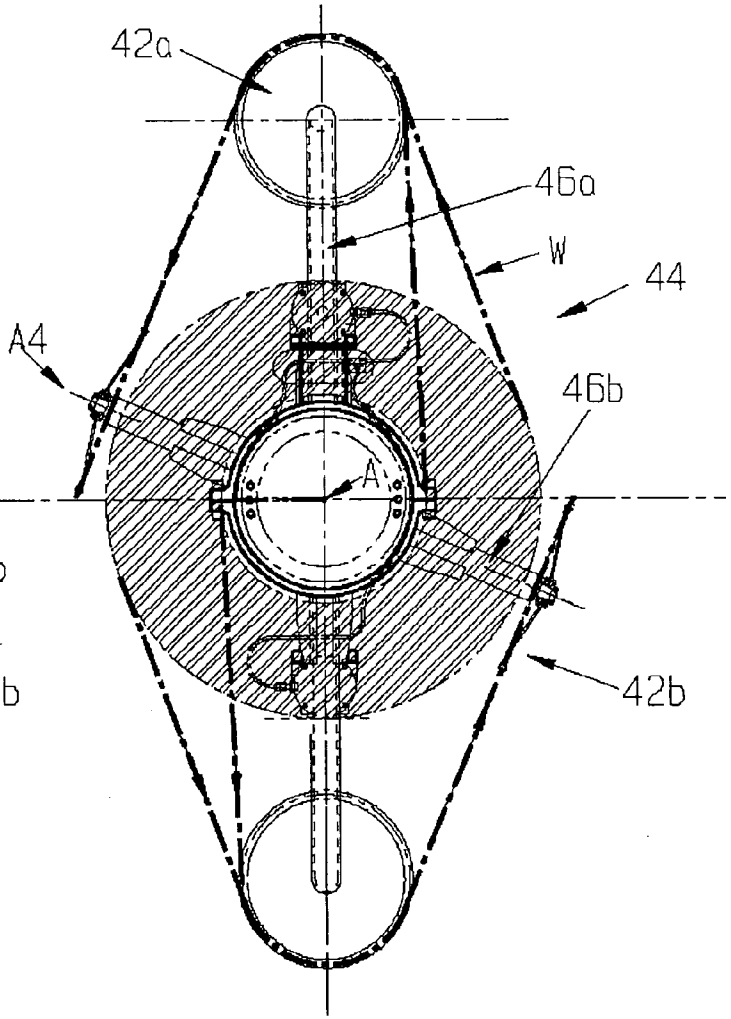
FIG. 6 is similar to FIG. 2, but illustrating an alternate arrangement of the pulleys forming part of the take-off mechanism.
Figure 7:
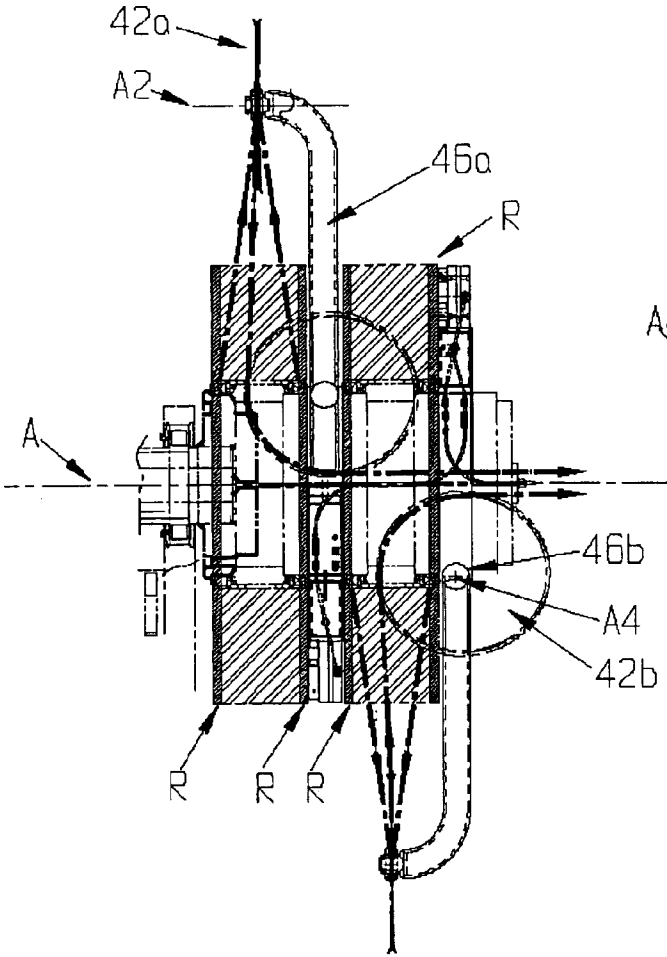
FIG. 7 is a side elevational view of the embodiment illustrated in FIG. 4.

In FIGS. 6 and 7 still another embodiment is illustrated, in which the axis A4 of the second sheave 42*b* is perpendicular to and extends through the shaft axis A. In other respects, the embodiment 44 shown in FIGS. 6 and 7 is similar to the embodiment shown in FIGS. 4 and 5.

Figure 8:
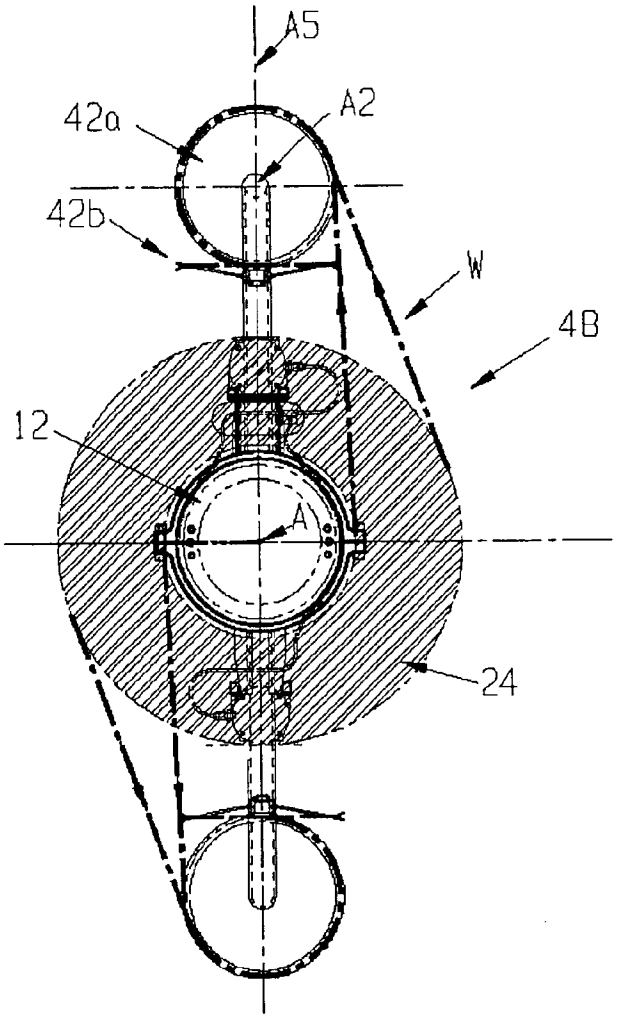
FIG. 8 is similar to FIG. 6, which is similar to FIG. 2, but illustrates an alternate arrangement of the pulleys forming part of the take-off mechanism.
Figure 9:
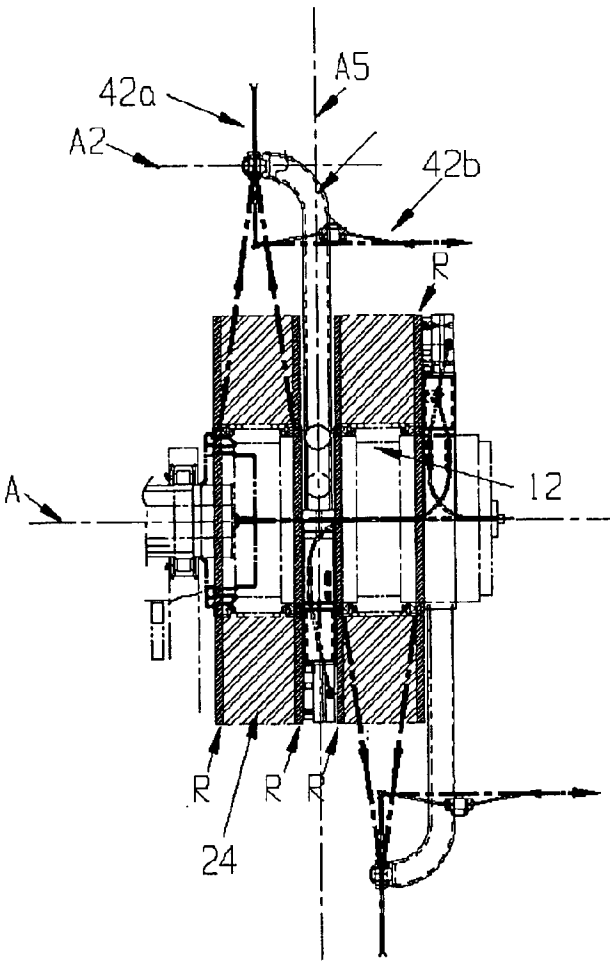
FIG. 9 is a side elevational view of the embodiment illustrated in FIG. 4.

In FIGS. 8 and 9, which show yet another embodiment similar to that shown in FIGS. 4 and 5, the axis A5 of the second sheave 42*b* is perpendicular to and extends through both the shaft axis A and through the axis A2 of the first sheave 42*a*. It should be clear that these are merely illustrative and that other sheave arrangements may be possible. What is important is that the sheaves be mounted on one or more supports that are themselves mounted on the strander shaft. Thus, in FIGS. 2–5, the two sheaves are mounted on a common support provided with offset extensions. In FIGS. 6 and 7, two separate supports 46*a*, 46*b* are provided, each of which is mounted on the concentric strander shaft 12. In each case, the support or supports must have axial dimensions that clear the adjoining spaced bobbins and do not exceed the axial interbobbin spaces S (FIG. 3). Once the sheaves are telescoped beyond the envelope E and beyond the outermost peripheries of the rims of the bobbins, there is substantial flexibility in selecting the diameters of the sheaves, as well as the positions and orientations in which they are arranged.

Referring again to FIG. 1, one arrangement of the pay-off devices is to provide at least one sheave or sheaves or pulleys associated with each bobbin. However, in order to arrange the wires or conductors evenly about the strander and to provide a more balanced arrangement, the bobbins are preferably angularly offset from each other. This also provides greater clearances between sheaves so that the sheaves of adjacent bobbins do not interfere with each other and can be oriented in desired positions. In FIG. 1, the axially successive sheaves are shown arranged on diametrically opposite sides of the concentric shaft 12. In practice, a more useful arrangement positions the take-off sheaves slightly angularly offset from each other about the axis A so that the wires or conductors W removed from the bobbins are preferably uniformly distributed about the concentric strander to improve collection and further processing at the closing point 18. Thus, where x pulleys are provided about a common strander shaft 12, and adjacent pulleys are substantially uniformly angularly offset from each other about the concentric axis A, the angle β (FIG. 12) is equal to 360°/x. In the embodiment shown in FIG. 1, where twelve sheaves are provided substantially uniformly spaced from each other, adjacent sheaves are preferably angularly offset from each other approximately 30°. However, it is also possible to arrange the supports about the axis to provide strategic runways of groups of wires to facilitate threading of the machine. In this case, the supports and sheaves should be arranged symmetrically about the axis to maintain rotational balance. In fact, all the sheaves may be arranged on one side of the axial shaft with balance achieved in any suitable manner such as by a counterweight.

Figure 10:
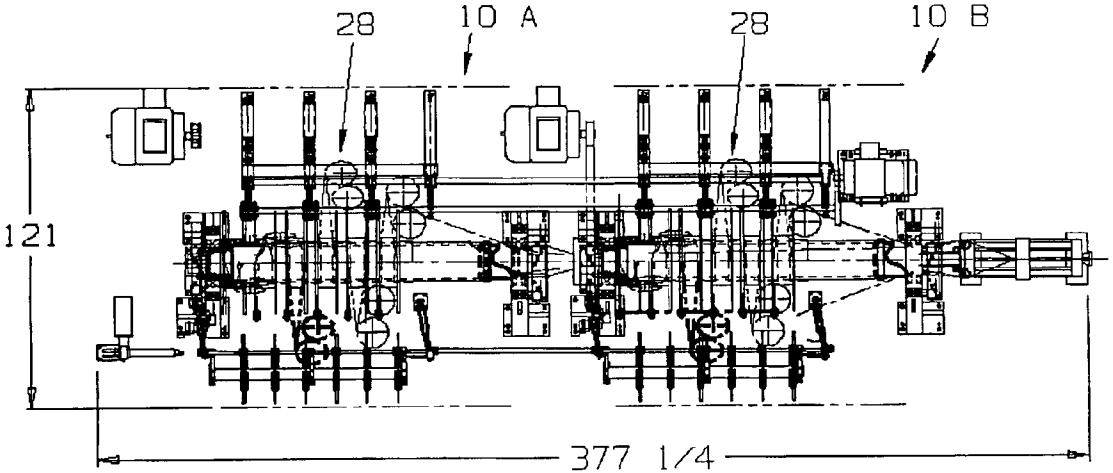
FIG. 10 is a top plan view of a concentric strander in accordance with the present invention, in which two concentric stranders are arranged in tandem.
Figure 11:
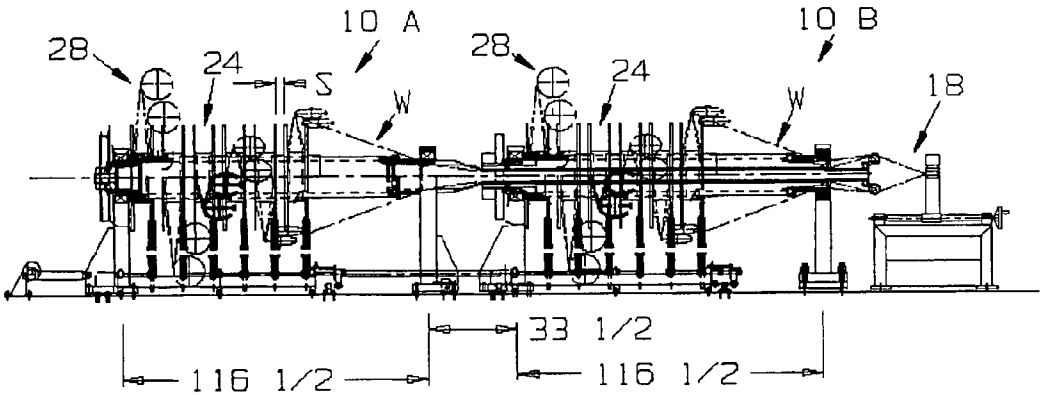
FIG. 11 is a side elevational view of the tandem arrangement shown in FIG. 10.

Referring to FIGS. 10 and 11, a strander arrangement is shown that consists of a plurality of stranders 10A, 10B, in tandem with each other, with the axes of both stranders arranged along the common machine axis A. Take-off sheaves are provided symmetrically about each concentric strander 10A, 10B to provide a balanced system during rotation of each strander. The stranded output from the upstream strander 10A is directed as a core to the next downstream strander 10B. Such an arrangement can be used when larger cables need to be made. It also is possible, with this arrangement, to utilize only one of the stranders 10A or 10B, when a smaller cable is required. As with the strander 10 shown in FIG. 1, when the two concentric stranders 10A and 10B are provided, each may be provided with six pairs of sheaves, with adjacent sheaves in each strander thereby being angularly offset by approximately 60°.

Figure 12:
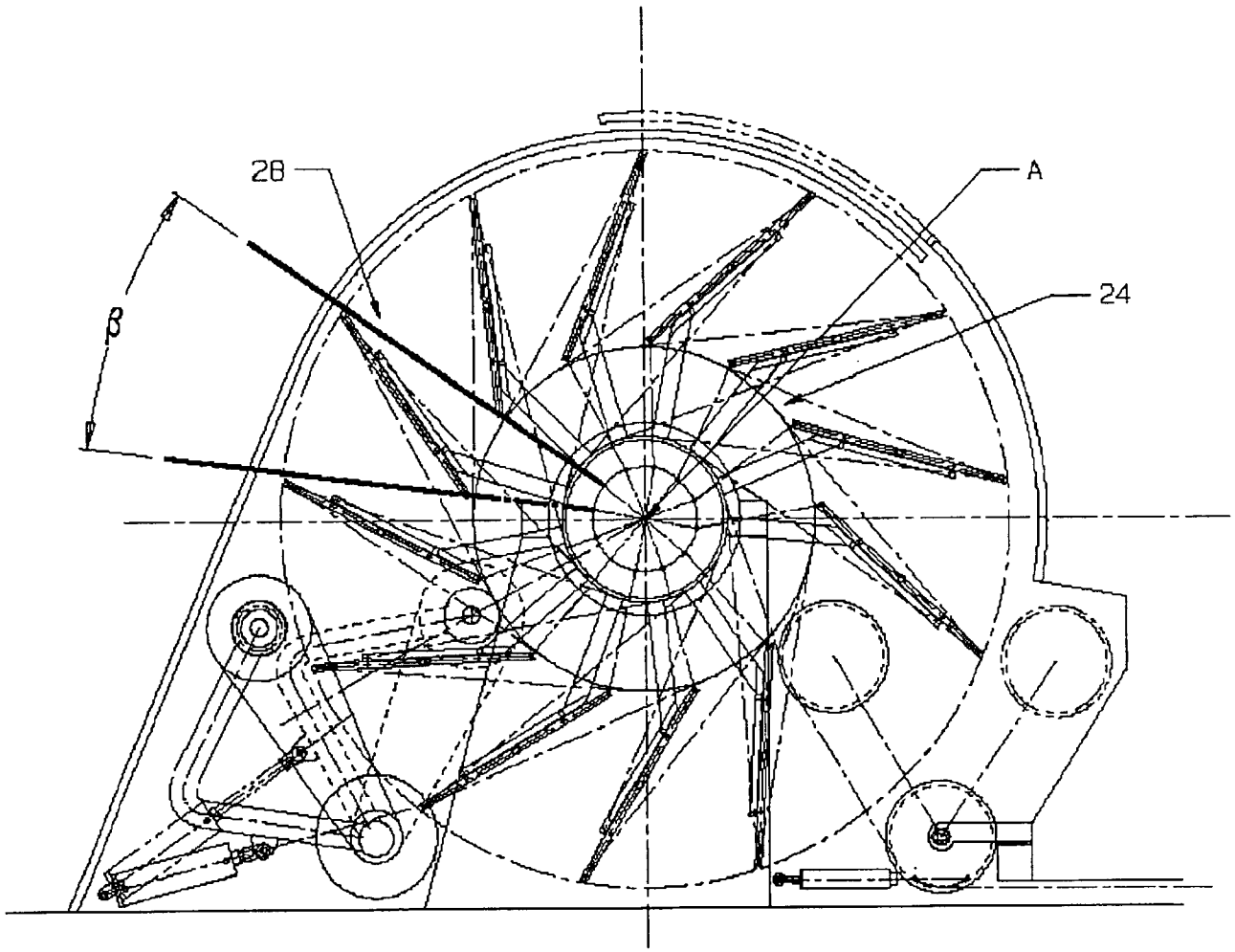
FIG. 12 is an enlarged end elevational view of the machine illustrated in FIGS. 10 and 11.

FIG. 12 is an end elevational view of the strander shown in FIG. 1, in which twelve bobbins are provided and, therefore, twelve pairs or sets of sheaves are provided each angularly offset about the axis A approximately 30°. FIG. 12 also makes it clear that by positioning the sheaves beyond the outer extremities of the rims of the bobbins, they can be oriented in different directions without interfering with the bobbins, and there is also substantial flexibility in the diameters that can be used for the sheaves to accommodate different wire or cable diameters or different products.

In the embodiments shown in FIGS. 2 and 3, the first guide sheave is substantially at 90° to the axis of the package. The embodiments illustrated in FIGS. 4–9 differ in that the axis of the first guide sheave is substantially parallel to the axis of the package. A significant advantage is that the section of the sheave that cuts through the air when the machine rotates is significantly reduced. Furthermore, the swing of the guide system for giving a fleeting angle from the package to the guide pulley is reduced. The smaller swing and the resulting reduced wind resistance lowers the power required for a given rotational speed and results in a more compact design. The embodiments illustrated in FIGS. 4 and 5 are the presently preferred embodiment.

In view of the foregoing, it is clear that the geometry of the concentric strander in accordance with the present invention minimizes the pitch between packages and subsequently the cage length while maintaining a substantial increase in the speed potential of the machine. Furthermore, the package pitch is not affected by the different wire guiding geometries associated with the different products that are suitable for this process.

The strength of the cage is the outside tube or structure. The cage lengths achievable with the present invention have considerable advantages in that they can be retro-fitted into existing lines substantially without changing the other components in the line. Generally, the present invention is better suited for larger wire diameters where a time to re-wind is shorter for a given package volume.

As indicated, the invention is equally applicable to a wide variety of materials—not just conductors. It is particularly attractive for spiral processors that require rewinding of material packages as a preferred step. Examples include taping, where the package supplied is not suitable for the process, and where rewinding is the practical solution. Binding, reinforcements and protection for composite pipes and cables and the like are obvious areas of application, as well as stranding, screening and armoring of a wide variety of products—round, flat, profiled power cables, etc. Further, the rewind process can provide other functions, including, for example, the trapezoidal rolling of round input wires or the coating of material for identification or lubrication, or other such functional purposes.

The present invention can also be used to provide a "twin version," as has been proposed by the prior art central strander machines, in which it is possible to rewind while the line is operating for smaller wire diameters.

While this invention has been described in detail with particular reference to preferred embodiments thereof, it will be understood that variations and modifications will be effected within the spirit and scope of the invention as described herein and as defined in the appended claims.

What is claimed is:

1. A concentric strander comprising an elongate concentric shaft defining a shaft axis; bearing support means for rotatably supporting said concentric shaft; a plurality of wire bobbins substantially equally spaced from one another along said shaft to form inter-bobbin spaces and each having a bobbin axis substantially coextensive with said shaft axis for rotation about said shaft, said bobbins each having maximum radial diameter; closing means at a downstream end of said shaft for receiving the wires from each of said bobbins and applying them on a core; take-off means mounted on said shaft and associated with a wire bobbin for taking off a wire wound on a bobbin and guiding it from said bobbin to a point radially outward beyond said maximum predetermined radial diameter and subsequently guiding the wire axially to a point substantially proximate to said closing means along a direction substantially parallel to said shaft axis and at a radial distance substantially corresponding to said radially outward point to define, upon rotation of said concentric shaft, a cylindrical envelope; first drive means for rotating said shaft; and second drive means for driving said wire take-off means, said inter-bobbin spaces required to support said wire take-off means having axial dimensions substantially independently of the diameters of the wires that need to be processed by the strander.

2. A concentric strander as defined in claim 1, wherein said wire take-off means comprises a pulley support mounted on said concentric shaft proximate to an associate wire bobbin and extending radially beyond said maximum predetermined radial diameter; and at least one pulley rotatably mounted on each pulley support to position said at least one pulley totally beyond said cylindrical envelope.

3. A concentric strander as defined in claim 2, wherein said wire take-off means comprises two pulleys supported on each pulley support.

4. A concentric strander as defined in claim 3, wherein a first pulley for initially engaging a wire has an axis of rotation inclined relative to a horizontal plane extending through said shaft axis.

5. A concentric strander as defined in claim 4, wherein said first pulley is substantially co-planar with a second pulley for directing the wire along said cylindrical envelope.

6. A concentric strander as defined in claim 3, wherein said first pulley for initially engaging a wire has an axis of rotation substantially parallel to said shaft axis.

7. A concentric strander as defined in claim 6, wherein said axis of said first pulley is offset from the axis of the second pulley, for directing the wire along said cylindrical envelope, by an angle of approximately 90°.

8. A concentric strander as defined in claim 6, wherein said axis of said second pulley is inclined relative to a horizontal plane extending through said shaft axis.

9. A concentric strander as defined in claim 6, wherein said axis of said second pulley is perpendicular to and extends through said shaft axis.

10. A concentric strander as defined in claim 6, wherein the axis of said second pulley is perpendicular to and extends through both said shaft axis and said axis of said first pulley.

11. A concentric strander as defined in claim 1, wherein said wire take-off means are interchangeable to accommodate different diameter wires without changing said inter-bobbin spacing.

12. A concentric strander as defined in claim 1, wherein said wire take-off means comprises at least one pulley associated with each bobbin, said at least one pulley associated with each two axially adjacent bobbins being angularly offset from each other to provide clearance therebetween.

13. A concentric strander as defined in claim 12, wherein said pulleys are arranged symmetrically about said concentric shaft to provide a balanced system during rotation of said concentric shaft.

14. A concentric strander as defined in claim 13, wherein axially successive pulleys are arranged on diametrically opposite sides of said concentric shaft.

15. A concentric strander as defined in claim 14, wherein an even number of pulleys are provided and arranged within a plane extending through said shaft axis, one half being arrange on one side of said shaft axis and the other half of said pulleys being arranged on the other side of said shaft axis.

16. A concentric strander as defined in claim 12, wherein said adjacent pulleys are offset 180° about said shaft axis.

17. A concentric strander as defined in claim 12, wherein x pairs of pulleys are provided, and said adjacent pulleys are offset from each other by an angle $\beta$ about said concentric axis, where $\beta=360°/x$.

18. A concentric strander as defined in claim 17, wherein twelve pulleys are provided substantially uniformly spaced from one another, adjacent sheaves being angularly offset from each other approximately 30°.

19. A concentric strander as defined in claim 17, wherein a plurality of concentric stranders are arranged in tandem to each other to arrange the axes of said stranders coextensively along a common machine axis, sheaves being provided symmetrically about each concentrical strander to provide balanced systems during rotation of each strander, stranded output from an upstream strander being directed as a core to a next downstsream strander.

20. A concentric strander as defined in claim 19, wherein two tandem concentric stranders are provided each with six pairs of sheaves, with adjacent sheaves of each strander being angularly offset by approximately 60°.

* * * * *